US005992625A

United States Patent [19]

Loiselle

[11] Patent Number: 5,992,625

[45] Date of Patent: Nov. 30, 1999

[54] ALLEN WRENCH HOLDER

[76] Inventor: Paul Loiselle, 19253 Midway, Southfield, Mich. 48075

[21] Appl. No.: 09/113,754

[22] Filed: Jul. 10, 1998

[51] Int. Cl.[6] ..... B65D 85/20

[52] U.S. Cl. ..... 206/377; 206/443

[58] Field of Search ..... 206/372, 376–379, 206/443

[56] References Cited

U.S. PATENT DOCUMENTS

| | | | |
|---|---|---|---|
| 2,465,619 | 3/1949 | Veit | 206/377 |
| 3,997,053 | 12/1976 | Bondhus | 206/377 |
| 4,767,006 | 8/1988 | Wasem | 206/377 |
| 5,394,984 | 3/1995 | Aiba | 206/377 |

*Primary Examiner*—Jim Foster
*Attorney, Agent, or Firm*—John R. Benefiel

[57] ABSTRACT

A holder for Allen wrenches or other L-shaped tools formed by a cylindrical body having an array of lengthwise grooves of graduated sizes distributed about its circumference each receiving one of a set of Allen wrenches. A radial hole extending into each groove receives the short end of the respective Allen wrench, which is gripped by a corresponding groove in an elastomeric plug fixed to one end of the holder body. The long end sections of the wrenches project beyond the end of the holder in a circular array, exposed to allow a size fit trial with a socket to be wrenched.

6 Claims, 2 Drawing Sheets

ALLEN WRENCH HOLDER

BACKGROUND OF INVENTION

This invention concerns holders of a type adapted to store an entire set of Allen wrenches or other L-shaped tools.

Allen wrenches comprise hexagonal rods bent at a right angle so as to form an L-shaped tool, providing a short and a long end for alternative engagement of Allen screws for maximum leverage or for maximum turning speed.

A storage holder for a set of different Allen wrench sizes has been found convenient to keep track of the rather small wrenches and to organize the set in graduated order to make it easier to locate a selected size. U.S. Pat. No. 4,767,006 describes such a holder. Finding the right wrench for a given socket is largely a matter of trial and error, since Allen wrenches are too small to be clearly marked, and similar socket sizes are difficult to differentiate by sight, even if the holder were provided with size markings.

Such holders are preferably compact to take up minimal space in a tool box. Accordingly, it is the object of the present invention to provide a compact holder for Allen wrenches or other L-shaped tools which allows a ready selection of a particular sized tool from an entire set stored in the holder.

SUMMARY OF THE INVENTION

The above recited object and others which will become apparent upon a reading of the following specification and claims are achieved by a holder formed by cylindrical holder body having a series of lengthwise grooves arranged about the circumference of the cylinder, each of a width to receive a respective Allen wrench size in the set.

Each groove ends in a radially extending hole formed into the holder body, sized to receive the short end section of the particular Allen wrench or other tool with sufficient clearance to allow tipping of the wrench end and swinging out the long end section of the tool for easy grasping during removal.

The radial holes are arranged in a generally helical pattern so as to locate the tip of the long end of each of the wrenches in a common plane lying well off one end of the body member. This exposes each wrench long end tip in a circular array spaced apart from each other and from the end of the holder body, making it easy to try each wrench in a socket for which a properly sized wrench is sought.

The wrenches are releasably held in position by a notched plug of a resilient material, which grips long end section of each of the wrenches securely, but readily allows a selected wrench to be pulled free.

The perimeter of the body member has a scalloped groove at the middle of the length of each of the grooves to facilitate removal with the finger tips of a user.

A slide-on tubular cover is also provided, and a hanger ring is attached to the top of the holder member.

DETAILED DESCRIPTION

Figure 1:
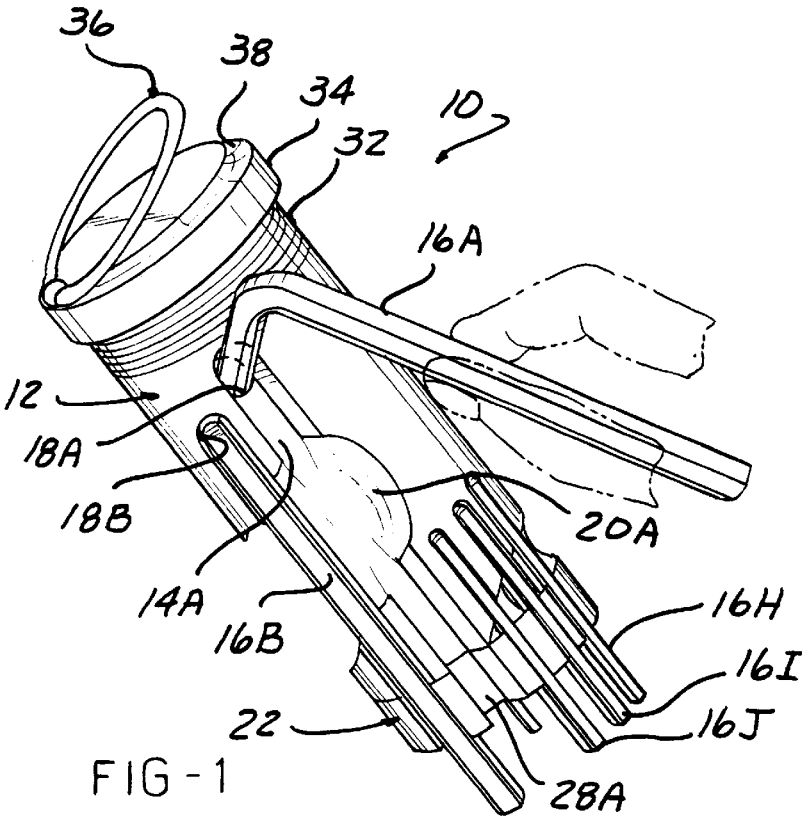
FIG. 1 is a perspective view of the holder according to the present invention, with a set of Allen wrenches held therein, and showing the removal of one of the wrenches.
Figure 2:
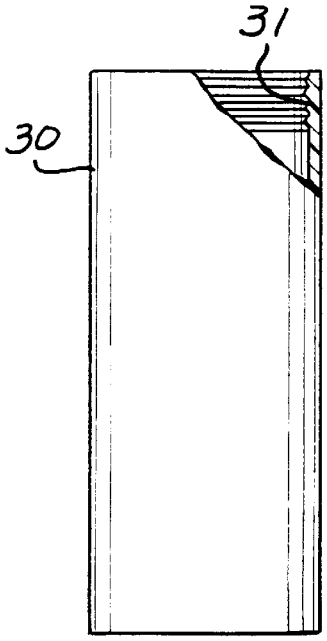
FIG. 2 is a side view of a tubular cover adapted to be telescoped over the holder and threaded thereto.

Referring to the Drawings, the holder 10 according to the present invention includes a cylindrical body 12 having a circumferentially spaced series of lengthwise extending surface grooves 14 A–J. The grooves 14 A–J are of graduated sizes, i.e. progressively shorter and narrower size to accommodate a set of Allen wrenches 16A–16J.

The upper end of each groove 14A–14J has a radial hole 18 extending into the holder body 12 of a size to receive the short end of the associated wrench with sufficient clearance to allow tipping as the long end is pulled out of its groove 14A–14J as shown.

Figure 5:
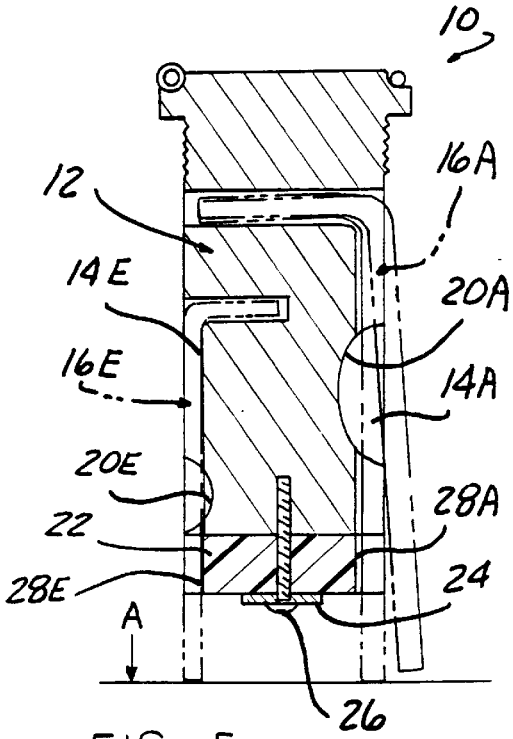
FIG. 5 is a lengthwise section through the holder body, showing two of the hole and groove features and also showing two Allen wrenches in phantom lines held in the respective grooves shown.

A scalloped area 20A–20J is also provided adjacent each groove 14A–14J to enable each individual tool 16A–16J to be exposed and thereby be able to be grasped at their midpoint by the index finger and thumb as shown in FIGS. 1 and 5.

An elastomeric plug 22 is secured to the bottom end of the holder member 12, as with a screw 24 and washer 26. The plug 22 has corresponding grooves 28A–28J, each aligned with a respective groove 14A–14J, but of a narrower width so as to grip and retain the long end section of each Allen wrench 16A–16J.

Figure 4:
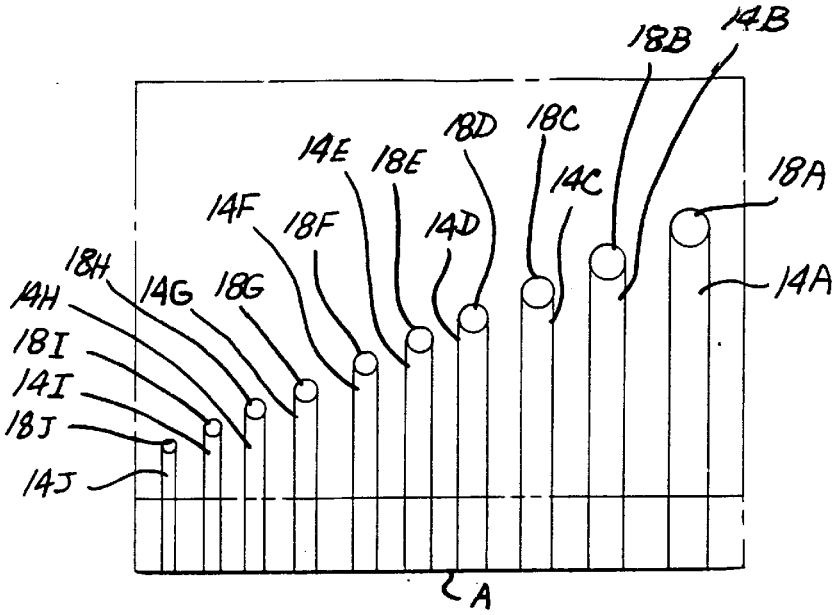
FIG. 4 is a development of the hole and groove array extending around the cylindrical holder body.
Figure 3:
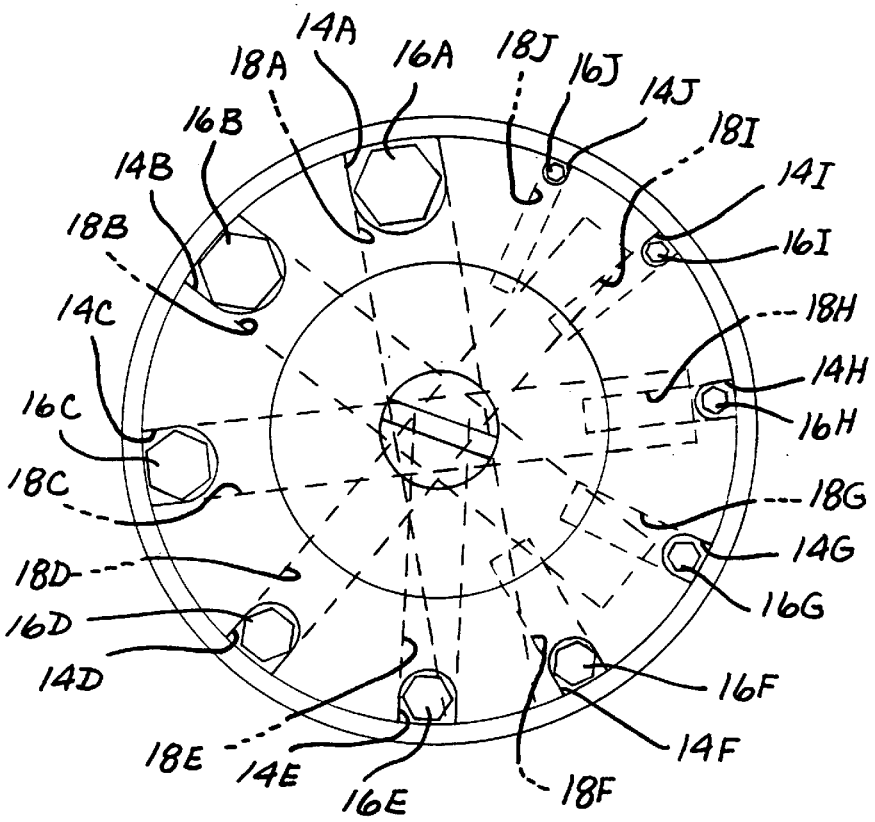
FIG. 3 is a bottom end view of the holder and set of Allen wrenches.

The length of each groove 14A–14J is such as to cause the same length of the long end portion of each Allen wrench 16A–16J to project an equal distance from the bottom end face of the plug 22, and lie in a common plane "A", as shown in FIG. 5, well clear of the holder 10. This locates the series of radial holes 18A–18J in a helical pattern, as indicated in the development of FIG. 4.

This allows convenient trying of a wrench for size with a socket without removal from the holder 10.

For removal, a projecting long portion of the selected wrench is pulled radially out to be freed from the grip of the plug 22. The finger and thumb can reach into the scalloped areas 20A–20J to withdraw the short portion from the radial hole 18A–18J.

A tubular cover 30 may be slid over the holder member 12 and wrenches 16A–16J, and has internal threads 31 mating with a threaded section 32 beneath a shoulder defined by a larger diameter top end 34.

A hanger ring 36 is pivotally attached to the top end face, with groove 38 provided to recess the ring 36 when not in use.

It can be appreciated that a compact holder has been provided which is very convenient in use, such that the objects of the invention have been achieved by the disclosed structure. The holder can be used for Allen wrenches or other similar L-shaped tools.

I claim:

1. A holder for a set of L-shaped tools each having a long end section and a short end section, comprising:

a cylindrical holder body;

a series of lengthwise surface grooves arrayed about the perimeter of said holder body, of graduated lengths and widths corresponding to a set of L-shaped tools;

a radial hole extending into each groove sized to receive a short end section of a tool of a size to have a long end section fit into said associated groove;

each groove shorter than the total length of the long end section of a respective one of said tools received therein to cause a tip of the long end section thereof to project beyond an end of the holder.

2. The holder according to claim 1 wherein a pair of scalloped areas are formed on either side of each groove to facilitate grasping a tool disposed in said groove when removing a respective tool from said holder body.

3. The holder according to claim 1 wherein each of said radial holes are large enough to allow tipping of a respective tool long end section out of its associated groove.

4. The holder according to claim 1 future including a tubular cover slidably received over said holder body.

5. A holder for a set of L-shaped tools each having a long end section and a short end section, comprising:

a cylindrical holder body;

a series of lengthwise surface grooves arrayed about the perimeter of said holder body, of graduated lengths and widths corresponding to a set of L-shaped tools;

a radial hole extending into each groove sized to receive a short end section of a tool of a size to have a long end section fit into said associated groove;

an elastomeric cylindrical plug attached to said holder body at said one end, having a series of lengthwise grooves corresponding to said grooves in said holder body and aligned therewith, said grooves in said elastomeric plug sized to releasibly grip a long end section of a tool disposed therein.

6. A holder for a set of L-shaped tools each having a long end section and a short end section, comprising:

a cylindrical holder body;

a series of lengthwise surface grooves arrayed about the perimeter of said holder body, of graduated lengths and widths corresponding to a set of L-shaped tools;

a radial hole extending into each groove sized to receive a short end section of a tool of a size to have a long end section fit into said associated groove;

said grooves and holes helically arrayed to dispose said tips of said long end sections portions of said tools in a common plane, displaced from said one end of said holder.

* * * * *